US007578589B2

(12) United States Patent
Asanuma

(10) Patent No.: US 7,578,589 B2
(45) Date of Patent: Aug. 25, 2009

(54) IMAGE FORMING APPARATUS

(75) Inventor: Shoji Asanuma, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 330 days.

(21) Appl. No.: 11/359,654

(22) Filed: Feb. 21, 2006

(65) Prior Publication Data

US 2006/0187291 A1 Aug. 24, 2006

(30) Foreign Application Priority Data

Feb. 24, 2005 (JP) ..... 2005-049115

(51) Int. Cl.
*B41J 29/13* (2006.01)

(52) U.S. Cl. ..... 347/108; 347/104; 399/107; 399/405; 399/126

(58) Field of Classification Search ..... 347/108, 347/104; 399/381, 405, 441, 107, 126
See application file for complete search history.

(56) References Cited

U.S. PATENT DOCUMENTS 6,546,228 B2 * 4/2003 Motohashi et al. ..... 399/401
6,736,395 B2 * 5/2004 Frey et al. ..... 271/273
6,796,736 B1 * 9/2004 Shiraishi et al. ..... 400/692
6,829,453 B2 * 12/2004 Kouzu ..... 399/124
2005/0002683 A1 * 1/2005 Saito et al. ..... 399/107

FOREIGN PATENT DOCUMENTS

| | | |
|---|---|---|
| JP | 9-255209 | 9/1997 |
| JP | 10-213936 | 8/1998 |
| JP | 2002-154705 | 5/2002 |
| JP | 2004-137049 | 5/2004 |

* cited by examiner

*Primary Examiner*—Manish S Shah
*Assistant Examiner*—Laura E Martin
(74) *Attorney, Agent, or Firm*—Cooper & Dunham, LLP

(57) ABSTRACT

An image forming apparatus is provided with a openable/closable conveyance cover enabling exposure of a recording paper conveyance path on which recording paper is conveyed, on a top of a printer part carrying out recording on the recording paper, and has a conveyance cover lock part configured to fix a state in which the conveyance cover is opened, when recording paper jam occurs.

6 Claims, 9 Drawing Sheets

IMAGE FORMING APPARATUS

BACKGROUND

1. Technical Field

This disclosure relates to an image forming apparatus, and, in detail, to an image forming apparatus provided with a paper ejecting part in which recorded recording paper is stacked, on a top of a printer part (image forming part), and, provided with a scanner part (image reading part) on a top of the paper ejecting part. In particular, this disclosure relates to an image forming part configured as mentioned above, in which jammed recording paper can be easily removed therefrom.

2. Description of the Prior Art

In the prior art, as disclosed by Japanese Laid-open Patent Application No. 2002-154705 (patent document 1) for example, as shown in FIGS. 7 and 8, in an image forming apparatus, a scanner part 3 is provided on a top of a printer part 2 producing an image on recording paper, the scanner part 3 reading an image of an original placed on a contact glass. Further, a paper ejecting part 4 is disposed in a space between the printer part 2 and the scanner part 3 for ejecting recording paper on which an image has been produced by the printer part 2 and stacking the same. In this configuration, the paper ejecting part 4 is prevented from projecting from a side surface of the apparatus body.

FIG. 7 shows a perspective view of an appearance of the image forming apparatus in the prior art. FIG. 8 shows a perspective view of a state in which a cover of the image forming apparatus 200 is opened. This image forming apparatus is of an ink-jet type. A front cover 51 provided on a front surface of the apparatus shown in FIG. 7 is an articulated cover which is opened when an each color ink cartridge 35 is replaced. As shown in FIG. 8, when the front cover 51 is opened, respective color ink cartridges 35 are exposed.

Further, as shown in FIG. 7, a conveyance cover 52 separates between the printer part 2 and the paper ejecting part 4, and forms a part of a paper ejecting tray. When the conveyance cover 52 is opened, as shown in FIG. 8, a recording paper conveyance path which conveys recorded recording paper to the paper ejecting part 4 becomes accessible. When paper jam occurs in the recording paper conveyance path, the conveyance cover 52 may be opened and the jammed paper may be removed. In other words, the conveyance cover 52 is an openable/closable cover for exposing the recording paper conveyance path for removing jammed paper. For the purpose of allowing the opened conveyance cover 52 to be held in the space part of the paper ejecting part 4, the conveyance cover 52 may be opened in such a manner that it is bent at a plurality of fulcrums (although FIG. 8 actually shows a configuration such that the conveyance cover 52 is opened about a single fulcrum). After that, a conveyance path part accommodating the recording paper conveyance path is moved to a predetermined position in an opened state, and thus, the recording paper may be removed from a jam occurrence place.

When a side cover 53 is opened, as shown in FIG. 8, the recording paper conveyance path for conveying the recording paper from a paper feeding part to the image forming part becomes accessible. As a result, when paper jam occurs in this part, jam removing work can be made after the side cover 53 is opened.

FIG. 9 shows a side elevational sectional view of an internal configuration of the image forming apparatus 200 shown in FIGS. 7 and 8. In this configuration, as shown in FIG. 9, recording paper 1 held in a paper cassette 22 is supplied to an ink-jet engine 20, sheet by sheet, through the recording paper conveyance path 24 by means of a paper feeding unit 23 and so forth. The ink-jet engine 20 has a paper conveyance system employing an electrostatic absorbing belt 27, for example, and, on the recording paper 1 conveyed by the electrostatic absorbing belt 27, an image is transferred with a printing head 29 mounted on a carriage moving in a reciprocating manner in a main scan direction (direction perpendicular to the FIG. 9).

After that, the thus-recorded recording paper 1 is ejected and stacked in a paper ejecting tray 41, after passing through the recording paper conveyance path 24 by means of paper ejecting rollers 40. The recording paper conveyance path 24 between the paper feeding unit 23 and the paper ejecting rollers 40 is configured to have an S-shape shown in FIG. 9, and, component members such as conveyance guide plates 25, conveyance rollers 26 (or inverting conveyance rollers, not shown) and so forth are set at predetermined positions, whereby the recording paper 1 is conveyed in a predetermined direction in the recording paper conveyance path 24.

However, in the configuration of the image forming apparatus 200 described above with reference to FIGS. 7 through 9, in which the paper ejecting part 4 is provided between the printer part 2 and the scanner part 3, the conveyance cover 51 may be bent at the plurality of fulcrums (although FIG. 8 actually shows the configuration such that the conveyance cover 52 is opened about the single fulcrum as mentioned above) and thus may be opened and may be held in a narrow space of the paper ejecting part 4 as shown in FIG. 8 as mentioned above, for removing jammed paper when paper jam occurs there. In this case, generally speaking, the conveyance cover 52 cannot be held stably in this space without being supported in its opened state.

Therefore, a user should hold the conveyance cover 52 in the opened state by his or her hand, and the user should carry out jam removing work on the recording paper conveyance path 24 by the other hand, in many cases. In this case, the user cannot use both hands for the jam removing work, and as a result, the user may not easily remove the jammed recording paper. Thus, troublesome and time-wasting work may be required.

Further, even after the conveyance cover 52 is thus opened, the jammed paper may be hidden behind the conveyance guide plates 25, which are parts of the recording paper conveyance path, when the user tried to view the recording paper conveyance path 24 from the top. As a result, a place at which paper jam actually occurs may not be found out easily.

Further, in some case, paper jam occurs at such a place in the recording paper conveyance path 24, that, a user's hand can reach the jam occurrence place even if an opening angle of the conveyance path part accommodating the recording paper convenience path 24 in the space part is small. Although in such a case, for actually carrying out jam removing work, the conveyance path part should be moved and opened to such a predetermined position in the space part as that for a fully opened state, and be held as it is. As a result, a large amount of the conveyance path part opening work is required.

SUMMARY

In an exemplary embodiment of this disclosure, an image forming apparatus is provided in which a conveyance cover can be stably kept in an opened state, and thereby, jammed paper removing operation may be carried out with both hands of a user.

In another exemplary embodiment of this disclosure, a structure is provided such that jammed recording paper can be prevented from being hidden by a conveyance guide plate or such, and thus, a jam occurrence place can be found out easily.

In another exemplary embodiment of this disclosure, a configuration is provided such that, when a conveyance path part accommodating a recording paper conveyance path is opened and is held by a space part of a paper ejecting part, the thus-opened conveyance path part can be held at any of a plurality of opening angles, and thereby, the conveyance path part can be held at a minimum necessary opening angle corresponding to jam occurrence place.

According to a first aspect of this disclosure, an image forming apparatus provided with an openable/closable conveyance cover allowing exposure of a recording paper conveyance path through which recording paper is conveyed, on a top of a printer part carrying out recording on the recording paper, includes:

a conveyance cover lock part configured to keep a state in which said conveyance cover is opened, when recording paper jam occurs.

According to a second aspect of this disclosure, in the image forming apparatus according to the first aspect of the present invention, the conveyance cover lock part employs a magnet.

According to a third aspect of this disclosure, an image forming apparatus provided with an openable/closable conveyance cover allowing exposure of a recording paper conveyance path through which recording paper is conveyed on a top of a printer part carrying out recording on the recording paper, includes: a conveyance guide plate forming the recording paper conveyance path, wherein the conveyance guide plate has a cut-our part so that a situation in the recording paper conveyance path can be viewed when the conveyance cover is opened.

According to a fourth aspect of this disclosure, in the image forming apparatus according to the third aspect of the present invention, a plurality of the cut-out parts are provided at predetermined separations.

According to a fifth aspect of this disclosure, an image forming apparatus provided with an openable/closable conveyance cover allowing exposure of a recording paper conveyance path through which recording paper is conveyed, on a top of a printer part carrying out recording on the recording paper, includes: a conveyance path part lock part configured to hold a conveyance path part in any of a plural stages of an opening angle when the conveyance path part accommodating the recording paper conveyance path is opened after the conveyance cover is opened.

According to a sixth aspect of this disclosure, in the image forming apparatus according to the fifth aspect of the present invention, the conveyance path part lock part employs a plurality of sorts of supporting parts having different lengths and a stopper hole for fitting any of the plurality or sorts of supporting parts.

In the image forming apparatus configured as described above, even when a paper ejecting part is provided in a narrow space between a printer part and a scanner part, a conveyance cover (in other words, a cover for allowing exposure for and removing jammed paper) can be held stably in an opened state. As a result, a user can use his or her both hands to carry out jam removing work, and thus, operationality and work efficiency can be improved.

Further, since a conveyance guide plate which is a part of a recording paper conveyance path is cut out, the inside of the recording paper conveyance path can be viewed from the outside therethrough when the conveyance cover is opened. As a result, jam occurrence place can be rapidly found out, and thus, efficiency of jam removing work can be improved.

Furthermore, when jam removing work is carried out in a condition in which the conveyance cover is opened, a conveyance path part accommodating a recording paper conveyance path can be held in any one of various opening angle stages. As a result, what a user should carry out is merely to open the conveyance path part to a minimum necessary opening angular position corresponding to a particular jam occurrence place. Accordingly, both hands' work can be carried out rapidly with a reduced amount of operation, and thus, operationality and work efficiency can be improved.

BRIEF DESCRIPTION OF THE DRAWINGS

Other aspects and further features of the present invention will become more apparent from the following detailed description when read in conjunction with the accompanying drawings.

DETAILED DESCRIPTION OF THE PREFERRED EMBODIMENT

Below, an embodiment of an image forming apparatus according to the present invention will be described with reference to figures. In the description below, description is made for a case of an ink-jet recording apparatus such as the prior art described above with reference to FIGS. 7 through 9 as one example. However, an image forming apparatus according to the present invention is not limited thereto, and, any other type of an image forming apparatus may be applied to. Further, a multi-function machine such as that having not only a copy function but also a printer function, facsimile function, and so forth, may be applied to.

Figure 1:
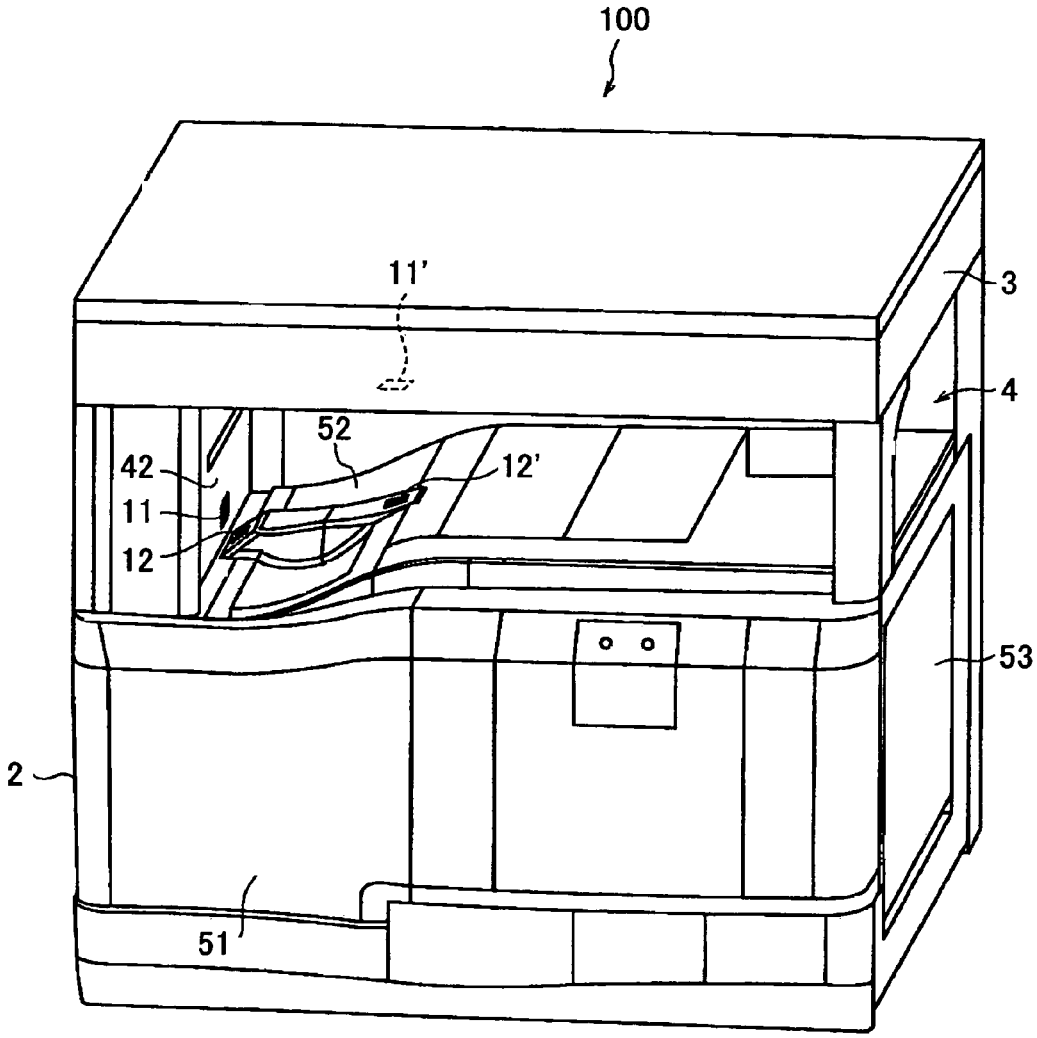
FIG. 1 shows a perspective view of one example of an appearance of an image forming apparatus according to the present invention.
Figure 2:
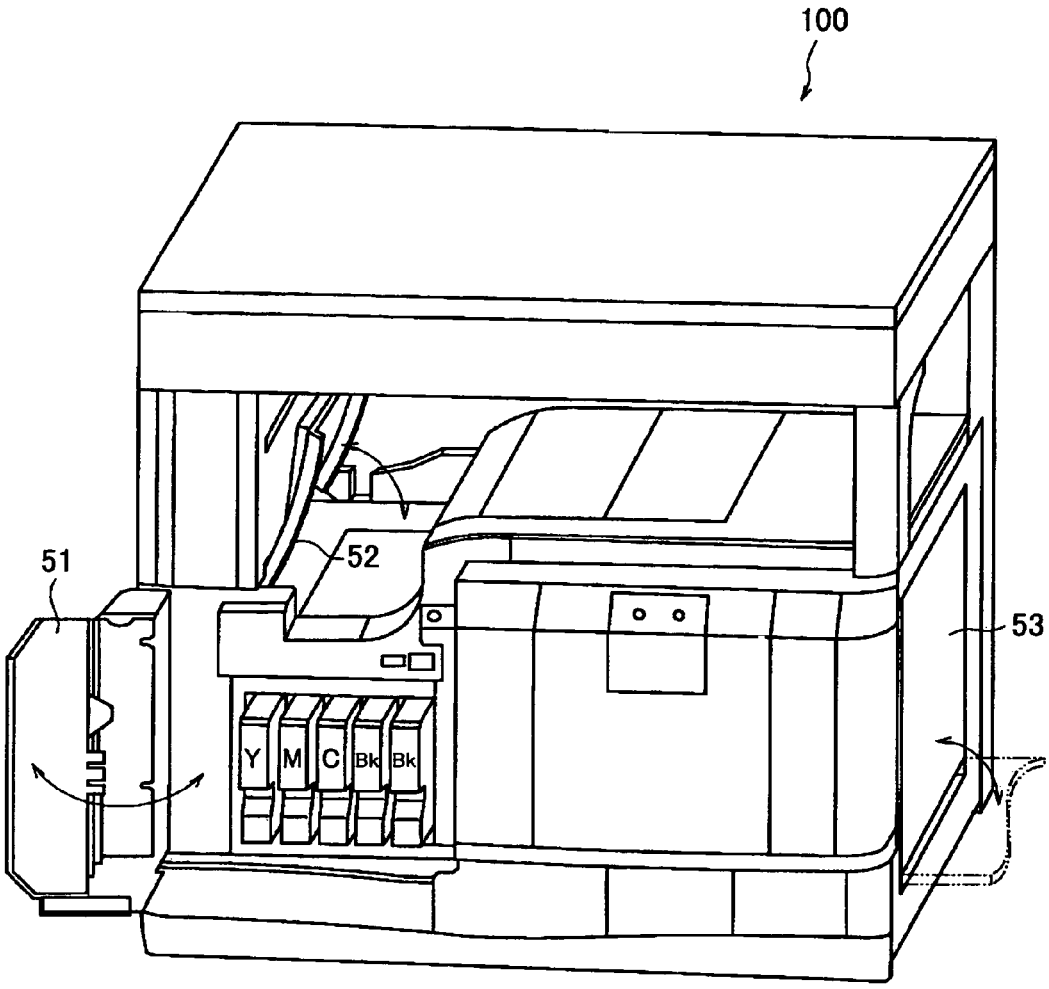
FIG. 2 shows a perspective view of one example of a state in which a conveyance cover is opened in the image forming apparatus according to the present invention shown in FIG. 1.
Figure 3:
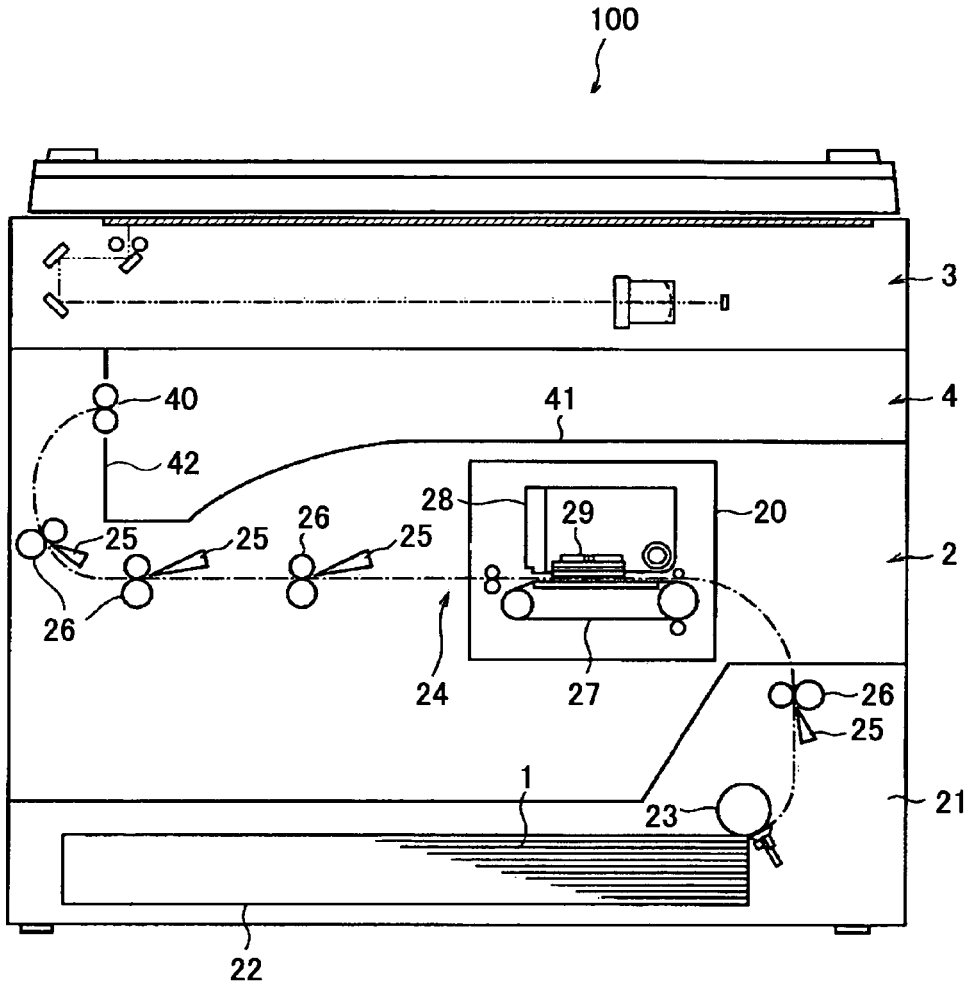
FIG. 3 shows a side elevational view of one example of an internal configuration of the image forming apparatus according to the present invention shown in FIG. 1.

FIG. 1 shows a perspective view of an example of an appearance of an image forming apparatus according to the present invention. FIG. 2 shows a perspective view of one example of a state in which a cover of the image forming apparatus 100 according to the present invention is opened. FIGS. 1 and 2 correspond to FIGS. 7 and 8 for describing above the prior art. FIG. 3 shows a sectional view of one example of an internal configuration of the image forming apparatus 100 according to the present invention, and corresponds to FIG. 9 for describing above the prior art. The same reference numerals are given to blocks having the same functions as those shown in FIGS. 7 through 9, and detailed description therefor is omitted.

Figure 7:
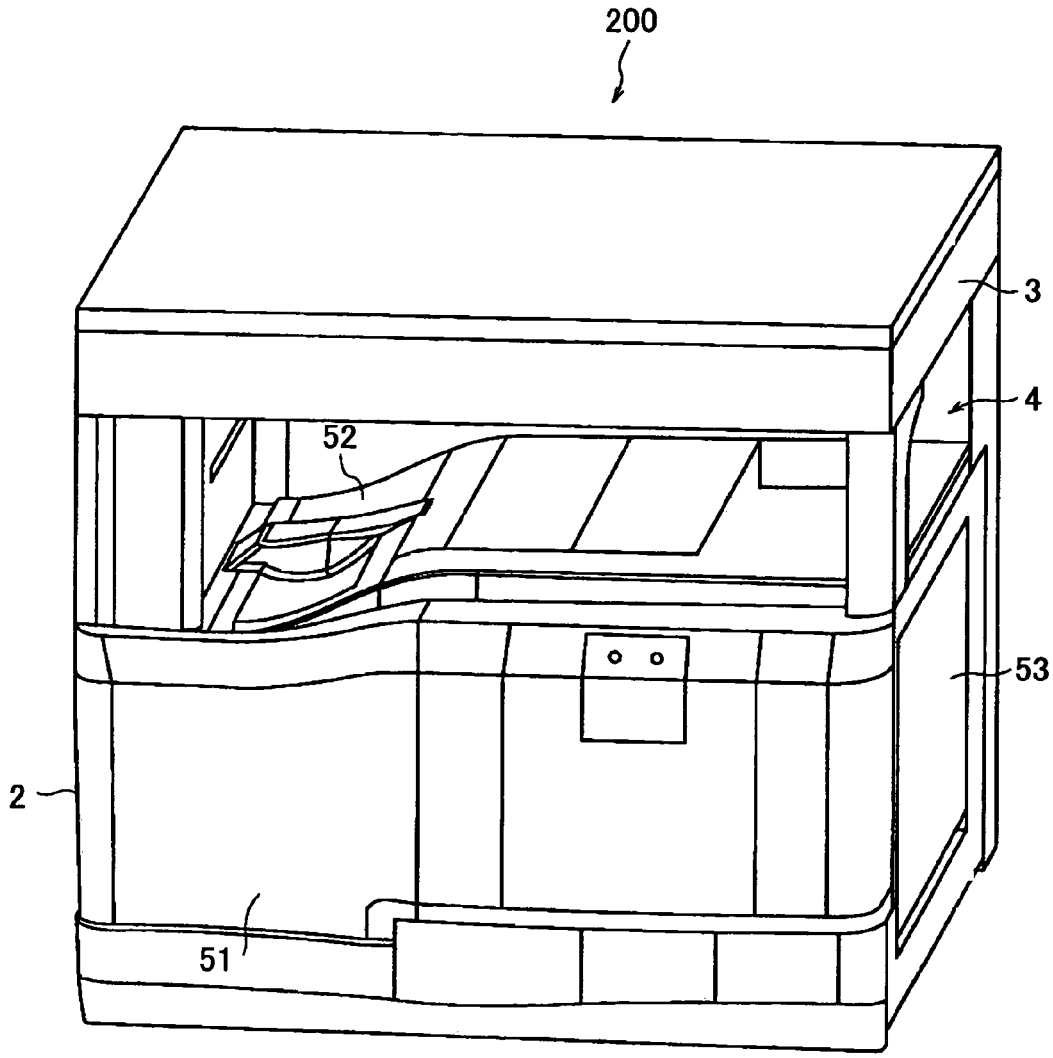
FIG. 7 shows a perspective view of an appearance of an image forming apparatus in the prior art.
Figure 8:
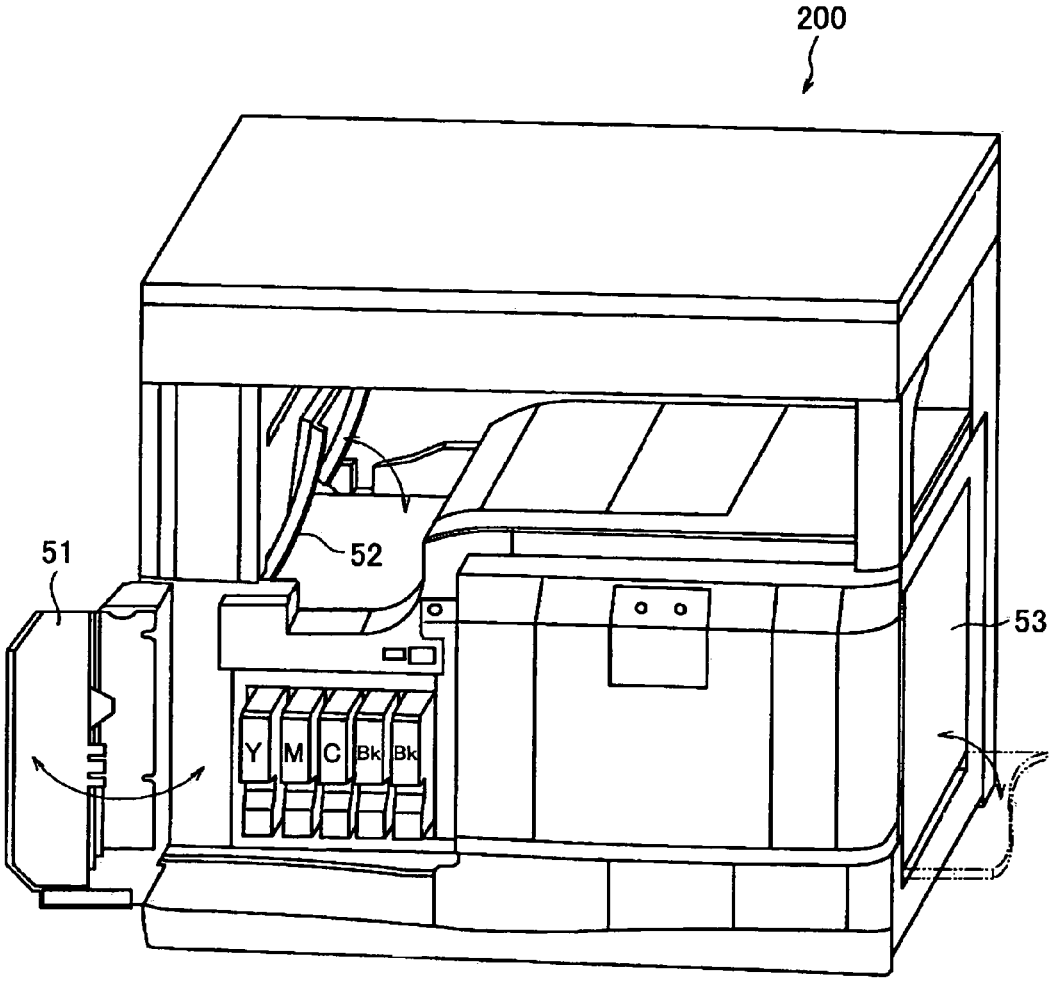
FIG. 8 shows a perspective view of the image forming apparatus in the prior art in a state in which a cover is opened.

The same as the case of FIG. 7, a paper ejecting part 4 for stacking recording paper having an image recorded thereto by a printer part 2 is disposed in a space between the printer part 2 forming an image on recording paper and a scanner part 3 reading an image from an original set on a contact glass, in the image forming apparatus 100 shown in FIG. 1. Thereby, the paper ejecting part 4 is prevented from projecting from a side surface of the apparatus body.

Further, an articulated front cover 51 shown in FIG. 1 provided on a front of the apparatus is the same as that of FIG. 7, and, when the front cover 51 is opened, respective color ink cartridges 35 are exposed. As a result, the color ink cartridges can be replaced.

A conveyance cover 52 shown in FIG. 1 is the same as that of FIG. 7, separates between the printer part 2 and the paper ejecting part 4, and forms a part of a paper ejecting tray 41 shown in FIG. 3. When the conveyance cover 52 is opened, a user can access a recording paper conveyance path which conveys recording paper having an image recorded thereto, to the paper ejecting part 4. As a result, when paper jam occurs in the recording paper conveyance path, the paper jam can be handled, with the conveyance cover 52 thus opened. That is, the conveyance cover 52 acts as a cover for a user to remove paper jam, with the cover opened. As the conveyance cover 52 is thus detachably provided, the recording paper conveyance path can be exposed to the top thereof. When the conveyance cover 52 is thus opened, the conveyance cover 52 may be opened in such a manner that it is bent at a plurality of fulcrums (although FIG. 8 actually shows the configuration such that the conveyance cover 52 is opened about the single fulcrum as mentioned above) so that the conveyance cover 52 in the opened state can be held by a narrow space part of the paper ejecting part 4.

Different from the configuration in the prior art shown in FIG. 7, in the image forming apparatus 100 according to the present invention, as shown in FIG. 1, a magnet 11 is provided at a predetermined position of a paper ejecting cover 42 (i.e., the paper ejecting cover 42 having a paper ejecting hole for ejecting recording paper to the paper ejecting part 4) which forms a side surface of the paper ejecting part 4, and/or a magnet 11' at a predetermined position of a rear surface part of the scanner part 2 which forms a top surface of the paper ejecting part 4. Also, a metal plate 12 and/or a metal part 12' are provided to be attracted by the magnet 11 and/or the magnet 11', respectively, at respective positions of the conveyance cover 52 for contacting the magnet 11 and/or the magnet 11', respectively.

As a result, as shown in FIG. 2, when the conveyance cover 52 is opened in the narrow space of the paper ejecting part 4, the metal plates 12 and/or 12' provided on the conveyance cover 52 contact(s) the magnets 11 and/or 11' disposed on the side surface and/or the top surface of the paper rejecting part 4. Then, by means of magnetic force, these magnets and metal plates are attracted by each other, and as a result, even when a user, who has thus opened the conveyance cover 52, removes his or her hand from the conveyance cover 52, the conveyance cover 52 in the opened state can be held in this state stably. As a result, when the user carries out paper jam removing work, the user should not hold, by himself or by herself, with his or her hand, the conveyance cover 52, and thus, the user can carry out the paper jam removing work on the recording paper conveyance path 24 with both hands. Thus, according to the present invention, the user can use both hands for the paper jam removing work, and thus, operationality and work efficiency can be improved.

FIG. 1 shows the two magnets 11 and 11' and the two metal plates 12 and 12' as the conveyance cover lock part for stably holding the conveyance cover 52 in the opened state. However, depending on the magnetic force of the magnets, the number of sets of the magnets and the metal plates may be changed accordingly. Further, the places at which the magnets and the metal plates are deposed may be replaced by each other. That is, the magnets may be disposed on the conveyance cover 52, while the metal plates may be disposed on the side surface and the top surface of the paper ejecting part 4.

Further, as the conveyance cover lock part for stably holding the conveyance cover 52 in the opened state, other then the above-described method of employing the magnetic force of the magnets, any other method may be applied. For example, an L hook member may be fitted in a holding hole; an articulated arm may be employed to open the conveyance cover 52; or a spring is employed to press the conveyance cover 52 toward the side surface and the top surface of paper ejecting part 4.

Figure 9:
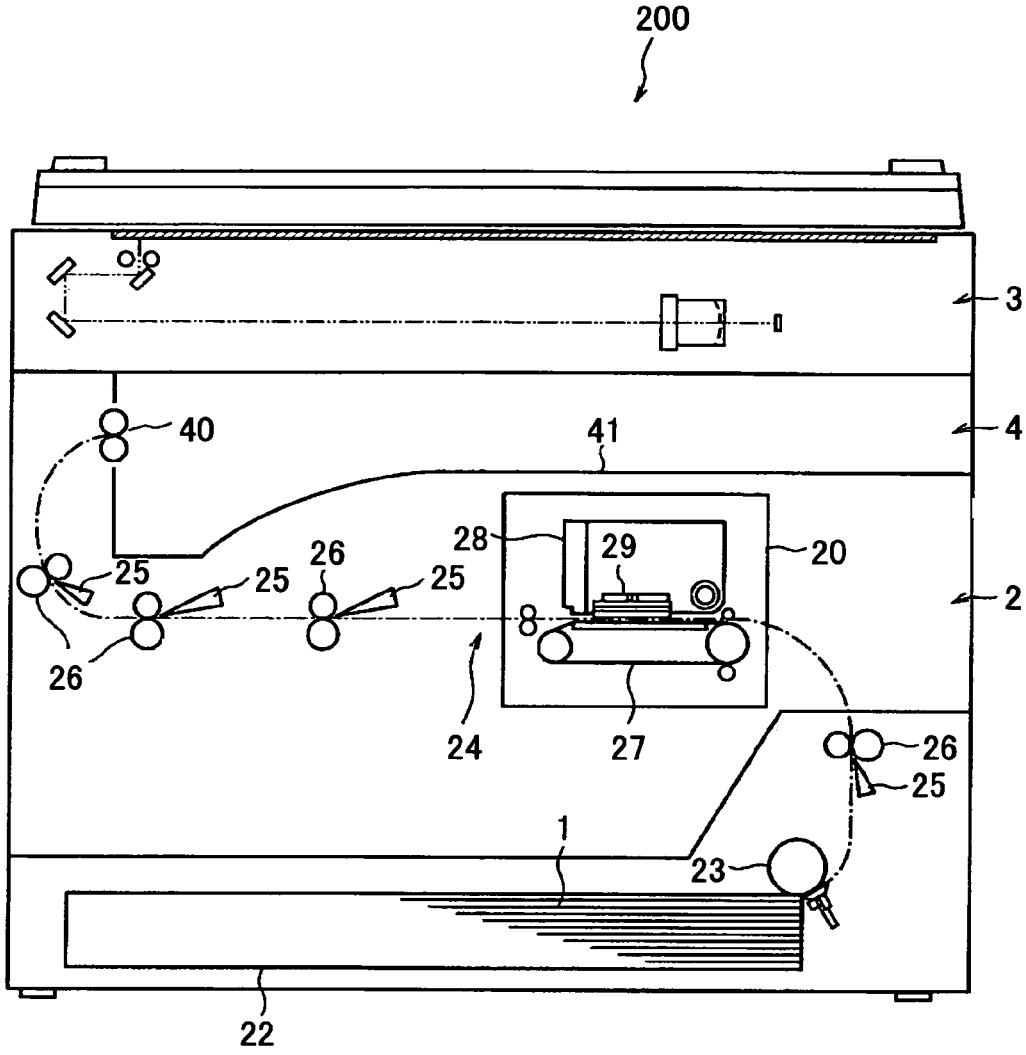
FIG. 9 shows a side elevational sectional view of an internal configuration of the image forming apparatus in the prior art.

As shown in the sectional view of FIG. 3, the image forming apparatus 100 according to the present invention has the same basic configuration as that of the prior art shown in FIG. 9. That is, below the printer 2, a paper feeding part 21 is disposed, and an ink-jet engine 20 and so forth are disposed thereabove. In the paper feeding part 21, a paper cassette 22 holding recording paper 1, a paper feeding unit 23 feeding the recording paper 1, sheet by sheet, to the ink-jet engine 20 from the paper cassette 22, and so forth, are provided.

The ink-jet engine 20 drives a printing head 29 mounted on a carriage 28 moved in a reciprocating manner in a main scanning direction (perpendicular to FIG. 3), and transfers and records an image on the recording paper 1 conveyed by an electrostatic absorbing belt 27, for example.

After that, the recording paper 1 on which the image is thus recorded is ejected to the paper ejecting tray 41 of the paper ejecting part 4 by means of paper ejecting rollers 40, and is stacked there. The recording paper conveyance path 24 extending from the paper feeding unit 23 to the paper ejecting rollers 40 has an S-shape the same as that shown in FIG. 9, component members such as conveyance guide plates 25, conveyance rollers 26 (or inverting conveyance rollers or such not shown), and so forth, are disposed at predetermined positions, and, by functions of the conveyance guide plates 25 and the conveyance rollers 26, the recording paper 1 on which the image has been thus recorded is conveyed in a predetermined direction through the recording paper conveyance path 24.

Thus, the recording paper conveyance path 24 thus conveying the recording paper 1 employs the conveyance guide plates 25, the conveyance rollers 26 and so forth. These components may be made of opaque material, and in this case, a paper jam occurrence place may not be easily viewed even when a user views from the top of the recording paper conveyance path 24 in a state in which the conveyance cover 52 is opened, depending on the actual paper jam occurrence place in a case where the paper jam occurs.

Figure 4:
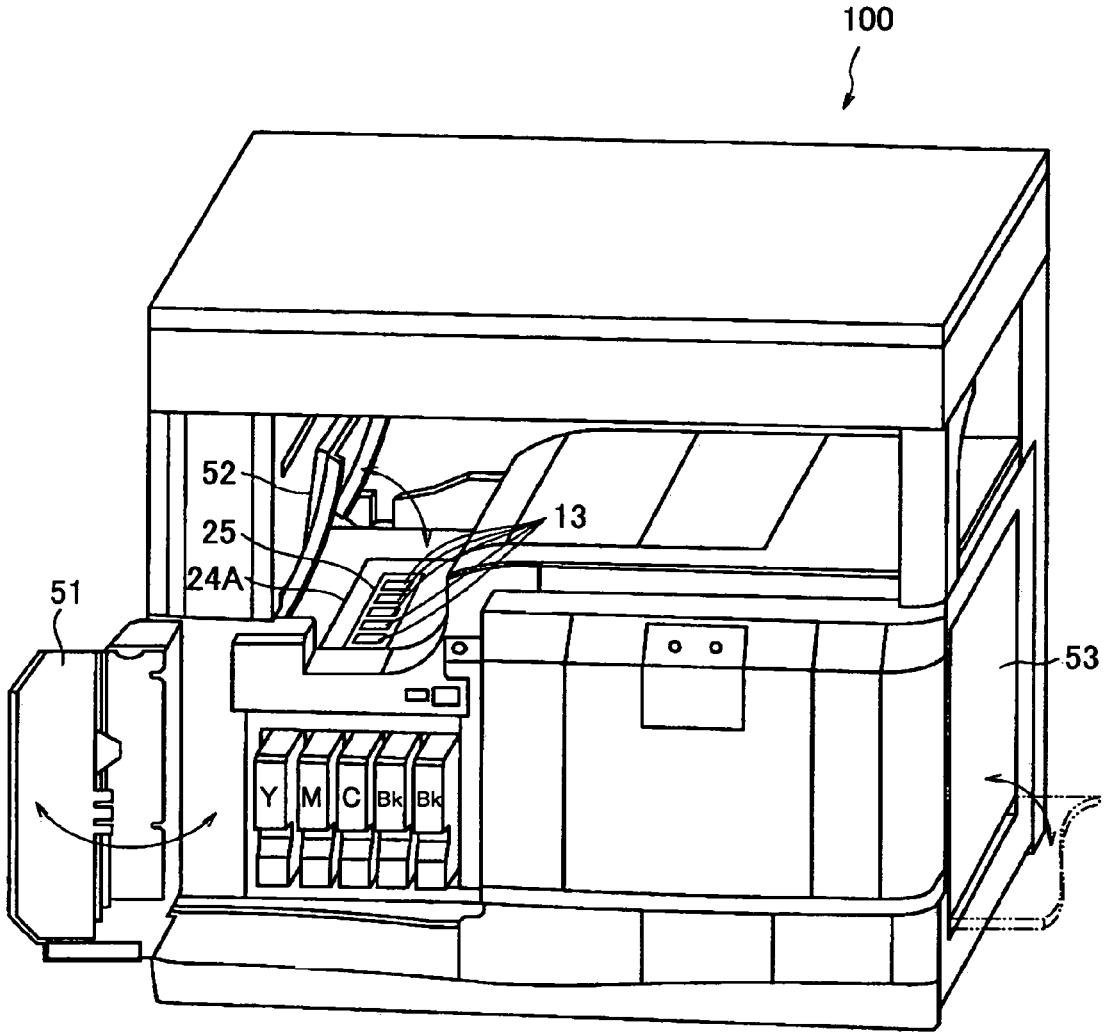
FIG. 4 shows a perspective view of one example in which cut-out parts are provided in a conveyance guide plate in the image forming apparatus according to the present invention shown in FIG. 1.

In order to solve this problem, in the image forming apparatus 100 according to the present invention, as shown in FIG. 4, a plurality of cut-out parts (i.e., openings) 13 are provided at predetermined appropriate separations at a predetermined position of each conveyance guide plate 25, for example in such a manner that a jam occurrence place in the recording paper conveyance path 24 can be easily viewed from the top in a state in which the conveyance cover 52 is opened. FIG. 4 shows a perspective view of one example in which the cut-out parts 13 are provided in the conveyance guide plate 25 of the image forming apparatus 100 according to the present invention.

The cut-out parts 13 provided in each conveyance guide plate 25 may be provided at appropriate separations with each cut-out part extending along the main scanning direction, the separations being determined in consideration of actual paper size of the recording paper 1. An actual size of each cut-out part 13 may be determined appropriately so that, from the top of the printer part 2 in a state in which the conveyance cover 52 is opened, a condition in the vicinity of the conveyance guide plate 25 may be viewed, and a condition throughout the entirety of the recording paper conveyance path 24 may be understood therefrom. In the embodiment shown in FIG. 4, the cut-out parts 13 are provided each extending along the main scanning direction in the conveyance guide plate 25. However, cut-out parts each extending along a sub-scanning direction may be provided instead. Further, durable and highly transparent material may be applied as the material of the conveyance guide plates 25.

As a result, when the recording paper conveyance path 24 is viewed from the top surface of the printer part 2 in a state in which the conveyance cover 52 is opened, jammed paper, if any, is prevented from being hidden by the conveyance guide plates 25 or such. Thus, a situation in the recording paper conveyance path 24 can be viewed thoroughly from the outside, a jam occurrence place can be rapidly found out, and thus, efficiency of jam removing work can be improved.

Figure 5:
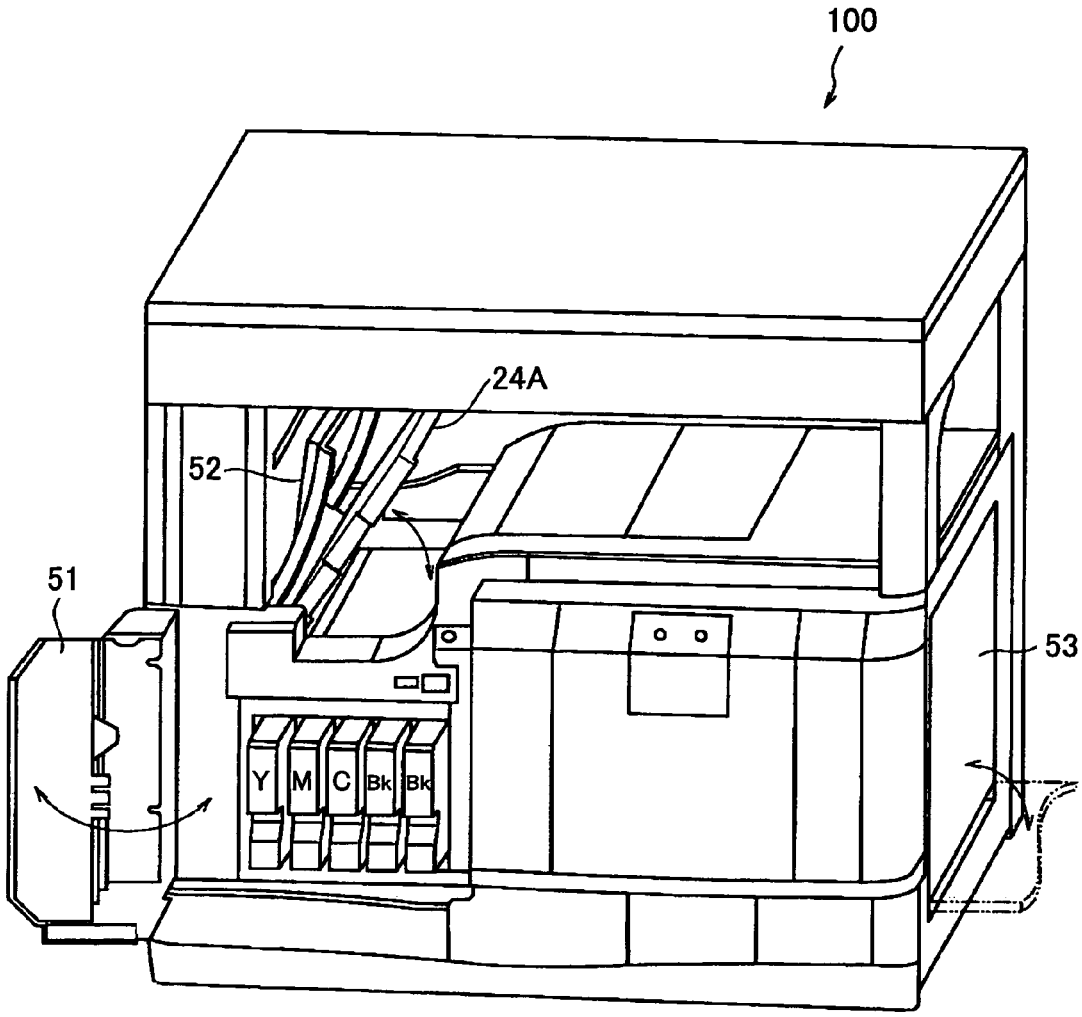
FIG. 5 shows a perspective view of one example in which the conveyance cover and a conveyance path part are opened in the image forming apparatus according to the present invention shown in FIG. 1.

After a user detects a jam occurrence place through the cut-out parts 13 shown in FIG. 4 provided at the appropriate separations provided in the conveyance guide plates 25, the user should remove the jammed paper as a result of exposing the jam occurrence place of the recording paper conveyance path 24 as a result of, as shown in FIG. 5, a conveyance path part 24A accommodating the recording paper conveyance path 24 being rotated and moved in a top left direction in FIG. 4 (i.e., counterclockwise) to a predetermined holding position. FIG. 5 shows a perspective view of one example of a state in which the conveyance cover 52 and the conveyance path part 24A are opened in the image forming apparatus 100 according to the present invention shown in FIG. 1.

In FIG. 5, a case is shown in which the conveyance path part 24A is rotated and moved to a fully opened state in a predetermined angular position. However, there is a case where the paper jam place in the recording paper conveyance path 24 is such that jammed paper may be removed even when the conveyance path part 24A is not rotated and moved to the fully opened state.

Figure 6:
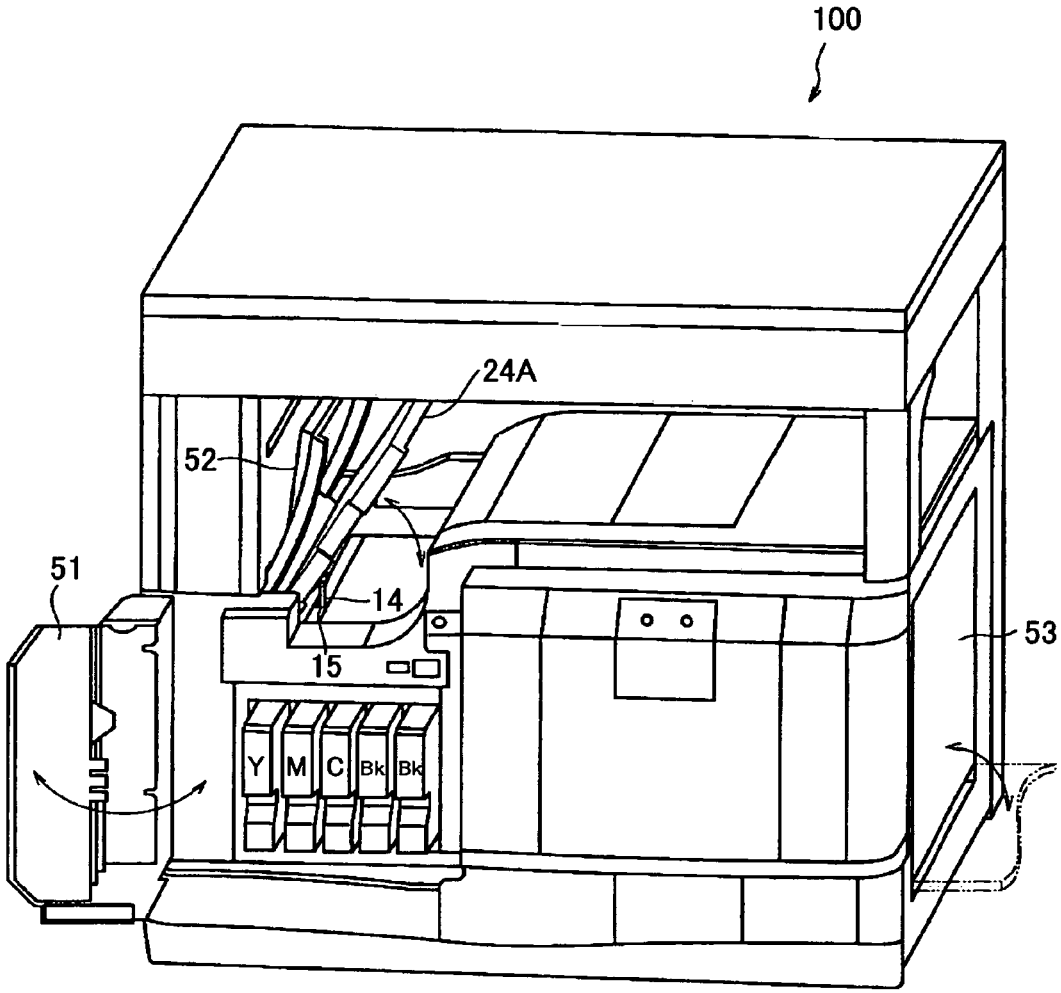
FIG. 6 shows a perspective view of one example in which an opening angle of the conveyance path part of the image forming apparatus according to the present invention shown in FIG. 1 is selectable from among a plurality of stages of an opening angle.

Therefore, as shown in FIG. 6, a plurality of (in the example of FIG. 6, two) supporting parts (or rods) 14 (mutually different in their lengths) at predetermined positions of the conveyance path part 24A, each being fixed to the conveyance path part 24A at one end thereof. For a case where jammed paper can be removed even when the conveyance path part 24A is opened in a relatively small amount, the shorter supporting part (or rod) 14 is fitted in a stopper hole 15 provided in a top surface of the printer part 2. Thus, the conveyance path part 24A can be held at a relatively smaller opening angle.

On the other hand, for a case where the conveyance path part 24A should be opened more widely so that the user's hand can reach the paper jam place, the longer supporting part (or rod) 14 in this case is fitted in the stopper hole 15. Thus, the conveyance path part 24A can be held at a larger opening angle. FIG. 6 shows a perspective view illustrating one example in which the configuration is provided in the image forming apparatus 100 shown in FIG. 1 such that the conveyance path part 24A can be held at any of the plurality of stages of the opening angle.

It is noted that the convenience path part lock method for stably holding the conveyance path part 24A at any of the plurality of stages of the opening angle is not limited to the above-described method of employing the plurality of supporting parts 14 and 14' having the different lengths in the conveyance path part 24 and inserting the other end of any thereof in the stopper hole 15. Instead, any other method may be applied. For example, the respective places of the supporting parts and the stopper hole may be exchanged between the conveyance path part 24A and the top surface of the printer part 2; holding of the conveyance path part 24A at any of a plurality of stages of opening angle may be achieved as a result of a tension rod having a predetermined length being made to contact a step-shape projection; or, a plurality of articulated arms having different lengths may be employed.

As a result, in order to found out a jam occurrence place by viewing the recording paper conveyance path 24 from the top surface of the printer part 2 for which the conveyance cover 52 is already opened, and carrying out jam removing work there, the conveyance path part 24A accommodating the recording paper conveyance path 24 should not necessarily be opened to a fully opened state. That is, depending on an actual jam occurrence place, the conveyance path part 24A can be opened to a minimum necessary opening angle and be held at the position. Thus, work with a user's both hands can be allowed with a smaller amount of operation, and operationality and efficiency of jam removing work are improved.

Further, the present invention is not limited to the above-described embodiments, and variations and modifications may be made without departing from the basic concept of the present invention claimed below.

The present application is based on Japanese Priority Application No. 2005-049115, filed on Feb. 24, 2005, the entire contents of which are hereby incorporated herein by reference.

What is claimed is:

1. An image forming apparatus provided with an openable/closable conveyance cover allowing exposure of a recording paper conveyance path through which recording paper is conveyed, on a top of a printer part carrying out recording on the recording paper, comprising:

a scanner part;

an ink-jet engine driving a printing head mounted on a carriage provided in the printer part, the printer part being configured to transfer and record an image on the recording paper;

a paper ejecting cover configured with a paper ejecting hole through which the recording paper is ejected onto a paper ejecting tray; and a conveyance cover lock part including a first magnet provided at a predetermined position on one of the paper ejecting cover and the conveyance cover, and a first metal part provided at a complementary position on the other of the paper ejecting cover and the conveyance cover, said complementary position of the first metal part corresponding to the predetermined position of the first magnet when the conveyance cover is opened, wherein the conveyance cover is formed as a part of the paper ejection tray and is provided above the printer part and under the scanner part, the conveyance cover, when opened, exposes a recording paper conveyance path having an approximate flat region situated between the ink-jet engine and a paper ejecting roller, the first metal part is attracted by the first magnet to hold a state in which said conveyance cover is opened, so as to expose the approximate flat region, when a recording paper jam occurs.

2. The image forming apparatus as claimed in claim 1, wherein:

said conveyance cover lock part comprises a magnet.

3. The image forming apparatus as claimed in claim 1, further comprising:

an image reading part at a location above the paper ejecting tray.

4. The image forming apparatus as claimed in claim 3, wherein said conveyance, cover lock part includes a second metal part provided on one of the conveyance cover and an under surface of the image reading part, and a second magnet provided on the other of the conveyance cover and the under surface of the image reading part, and the second metal part and the second magnet are positioned complementarily such that the second metal part is attracted by the second magnet to hold a state in which said conveyance cover is opened.

5. The image forming apparatus as claimed in claim 1, wherein a magnetic force between the first metal part and the first magnet when the first metal part and the first magnet are substantially in contact with each other is sufficient to maintain said conveyance cover in an opened position, even when the conveyance cover is not held by a user.

6. The image forming apparatus as claimed in claim 1, further comprising:

a paper ejection part including said paper ejection tray for stacking said recording paper after an image is recorded on the recording paper, wherein said conveyance cover separates said paper ejection part and the printer part of the image forming apparatus.

* * * * *